US005369706A

United States Patent [19]

Latka

[11] Patent Number: 5,369,706

[45] Date of Patent: Nov. 29, 1994

[54] RESYNCHRONIZING TRANSMITTERS TO RECEIVERS FOR SECURE VEHICLE ENTRY USING CRYPTOGRAPHY OR ROLLING CODE

[75] Inventor: David S. Latka, Dearborn, Mich.

[73] Assignee: United Technologies Automotive, Inc., Dearborn, Mich.

[21] Appl. No.: 148,665

[22] Filed: Nov. 5, 1993

[51] Int. Cl.[5] ..... H04K 1/00

[52] U.S. Cl. ..... 380/23; 380/48; 340/825.56; 340/825.69

[58] Field of Search ..... 380/23, 24, 25, 46, 380/48; 340/825.56, 825.69

[56] References Cited

U.S. PATENT DOCUMENTS

| | | | |
|---|---|---|---|
| 4,424,414 | 1/1984 | Hellman et al. . | |
| 4,596,985 | 6/1986 | Borgard et al. | 340/825.69 |
| 4,847,614 | 7/1989 | Keller | 340/825.56 |
| 4,876,718 | 10/1989 | Citta et al. . | |
| 4,928,098 | 5/1990 | Dannhaeuser | 340/825.56 |
| 5,146,215 | 9/1992 | Drori . | |
| 5,191,610 | 3/1993 | Hill et al. | 380/23 X |
| 5,241,598 | 8/1993 | Raith | 380/23 X |
| 5,243,653 | 9/1993 | Malek et al. | 380/48 |
| 5,252,965 | 10/1993 | Gidwani et al. | 340/825.56 |

*Primary Examiner*—Tod R. Swann
*Attorney, Agent, or Firm*—Harness, Dickey & Pierce

[57] ABSTRACT

Secret Information is stored in the transmitter and receiver of the keyless entry system. The information includes a resynchronization authorization code. When resynchronization is requested by the user pressing the appropriate key fob button, a random number is generated in the transmitter and sent to the receiver along with the resynchronization authorization code. The receiver tests the authorization code received with its stored code. If the codes match, the receiver substitutes the random number received from the transmitter for its existing stored access code, thereby placing the transmitter and receiver back in synchronization.

7 Claims, 3 Drawing Sheets

RESYNCHRONIZING TRANSMITTERS TO RECEIVERS FOR SECURE VEHICLE ENTRY USING CRYPTOGRAPHY OR ROLLING CODE

BACKGROUND AND SUMMARY OF THE INVENTION

The present invention relates generally to keyless entry systems. More particularly, the invention relates to a method for resynchronizing the transmitter/-receiver pair when synchronization is lost due to momentary power failure or a low battery condition, or repeated manipulation of the transmitter buttons when the receiver is out of range, for example.

Rolling code authentication is a common form of vehicle entry security. In such a system, a transmitter is provided in the form of a key fob and a receiver is positioned in the vehicle where it is able to receive encoded transmission from the key fob transmitter. Rolling code authentication can be performed by employing a simple linear counter which advances with each key fob command. The receiver in the vehicle is configured to always expect an increasing value and therefore it disallows repeating counter values. Thus to be in sync the transmitter counter should never fall behind the count of the receiver, nor should the transmitter counter be permitted to get too far ahead of the receiver count. More complex authentication using linear shift feedback register (LFSR) technology is also used as a more secure technique for vehicle entry security.

For a number of reasons, a rolling code authentication system can occasionally fall out of synchronization when the counter values of the transmitter are less than that of the receiver or when the transmitter counter values are greater than those of the receiver by a predetermined number. Loss of synchronization can occur when the transmitter is repeatedly cycled (by pressing the key fob buttons) when the receiver is out of range. Loss of synchronization can also occur when battery power is lost.

One way to ensure against loss of synchronization due to battery power loss is to outfit the transmitter with a nonvolatile memory such as an EEPROM which can be used to store the rolling values so they will not be lost. Being nonvolatile, the EEPROM will not lose synchronization due to a power interruption (e.g. loose battery connection or battery failure). The EEPROM protects the integrity of the counters when the internal RAM is powered-off.

However, EEPROM devices are comparatively expensive and it would be desirable to eliminate them from the rolling code authentication circuitry. This presents a problem, since without nonvolatile memory, a system would have to rely on RAM (volatile memory) to store counter values. The need to rely on RAM increases the possibility of corrupted counter values, since even temporary loss of power through a loose battery connection or loss of battery charge would break synchronization.

Loss of synchronization due to repeated cycling of the transmitter when the receiver is out of range is a more difficult problem to address even with EEPROM devices, since eventually, the EEPROM device will become full and will thereby loose the ability to re-establish synchronization. For example, an EEPROM device with capacity to hold twenty numbers would loose synchronization on the twenty-first key press of the transmitter fob while out of range of the receiver. In effect, the twenty-first key press would cause the matching number to be lost as the twenty-first number is added.

It would therefore seem desirable to have a panic button function or resynchronization function which the user could invoke to force resynchronization in the event it is lost. Such a function is difficult to provide without sacrificing security, however. Care must be taken to ensure that the resynchronization sequence cannot be easily recorded and mimicked by a thief. If the resynchronization codes are easily mimicked, it would be a simple matter to gain entry to the vehicle by imitating the resynchronization sequence and then supplying the receiver with a known access code, in effect reprogramming the lock to match the key of the thief. Existing technology has not adequately addressed this problem.

Accordingly, the present invention provides a secure method of synchronizing transmitter and receiver in a keyless entry system of the type which uses encrypted access codes to prevent unauthorized access. The method comprises storing secret information data in the transmitter and storing the same secret information data in the receiver. The secret information includes a resychronization authorization code which is common to both transmitter and receiver. Preferably this resynchronization authorization code is preprogrammed into the transmitter and receiver units during manufacture or by the dealer or installer of the keyless entry system. Further in accordance with tile invention there is stored at least a first access code in the transmitter and at least a first access code in the receiver. These access codes serve to permit access if the transmitter and receiver first access codes match. The access codes further serve to prevent access if the transmitter and receiver first access codes do not match.

According to the inventive method, when a resynchronization sequence is initiated (e.g. by pushing a panic button or resynchronization button) a first random number access code is generated at the transmitter. The transmitter then transmits the resynchronization authorization code and the first random number access code to the receiver. In the transmitter, the first random number access code is substituted for the first access code. Meanwhile, in the receiver, the transmitted resynchronization authorization code is compared with the resynchronization authorization code stored in the receiver. If the transmitted resynchronization authorization code and the stored resynchronization authorization code match, a substitution is made whereby the first random number access code is substituted for the first access code in the receiver. In this way, the first access codes of the transmitter and receiver are reset to match one another, thereby synchronizing transmitter and receiver.

For a more complete understanding of the invention, its objects and advantages, reference may be made to the following specification and to the accompanying drawings.

BRIEF DESCRIPTION OF THE DRAWINGS

FIGS. 3-6 are flowchart diagrams setting forth the synchronization method of the invention in detail.

DESCRIPTION OF THE PREFERRED EMBODIMENT

In order to understand the method of synchronizing some understanding of linear feedback shift register technology may be helpful, since the invention can be used with LFSR security systems. Accordingly, in FIG. 1 a four bit linear feedback shift register (LFSR) is depicted at 10. The shift register includes four memory cells in which four bits are stored, designated bit 3, bit 2 . . . bit 0, consecutively. The shift register is configured so that each cycle or rotation causes the contents of one bit to be shifted or transferred to its rightmost neighbor (with the exception of bits which feed an exclusive OR device).

Figure 1:
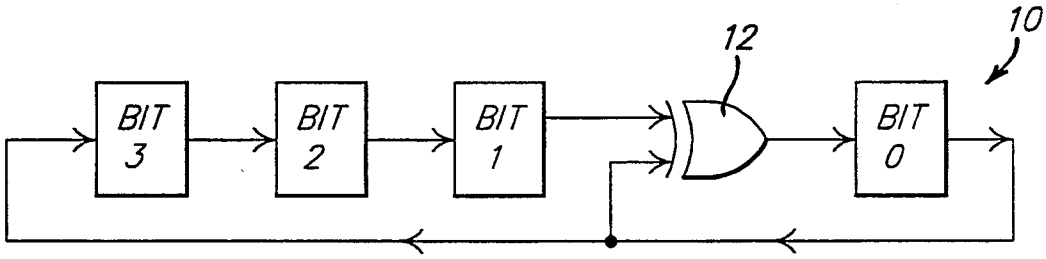
FIG. 1 is a block diagram of an exemplary four bit linear feedback shift register, useful in understanding the principles of the invention.

The LFSR device also includes one or more exclusive OR operations. In FIG. 1 single exclusive OR 12 has been illustrated, with its output supplying bit 0 and with its inputs connected to the output of bit 1 and the output of bit 0, as illustrated. Thus with each cycle or rotation, the contents of bit 1 are combined with the contents of bit 0 in an exclusive OR operation and the resultant is then stored at bit 0. The linear feedback shift register 10 illustrated in FIG. 1 is merely provided as an example. In practice, the shift register can be any number of bits, typically a larger number than four bits, and the number and location of exclusive OR operations can vary to provide different encryption codes.

In the keyless entry system the linear feedback shift register works by rotating the authentication bits, n times, through the shift register with exclusive OR feedback taps between a few of the bit locations. With each transmission, the transmitter performs a linear feedback shift register (LFSR) shift operation, which scrambles the authentication information and sends this scrambled authentication information to the receiver along with the selected command (unlock, lock, trunk, etc.). An identical LFSR operation on the receiver authentication variables is performed in the receiver after it receives a command from the transmitter. The receiver compares the results of its own LFSR operation to the authentication variables sent by the transmitter. The authentication information is validated if the receiver comparison matches.

A synchronization issue can arise when the transmitter authentication variables are lost due to power interruption or when the transmitter is repeatedly cycled when the receiver is out of range. The present invention provides a secure method for resynchronization of those variables.

Figure 2:
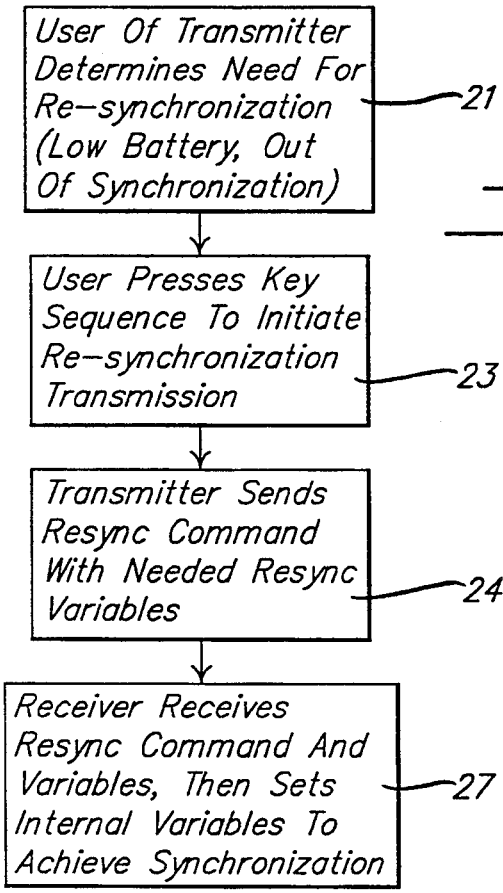
FIG. 2 is an overview flowchart diagram illustrating the principles of the invention.

Referring to FIG. 2, an overview of the synchronization method will be given. Thereafter, a detailed explanation will be given using FIGS. 3-6. Referring to FIG. 2, the synchronizing method is invoked when the user determines the need for resynchronization (i.e. The desired command keypress does not appear to work). This is illustrated at step 21. In response, the user presses a key sequence (step 23) to initiate resynchronization. In response to the keypress, the transmitter sends a resynchronization command, which includes the necessary resynchronization variables. This is depicted at step 25. Finally, the receiver receives the resynchronization command and variables and sets its internal variables to achieve synchronization (step 27).

Figure 3:
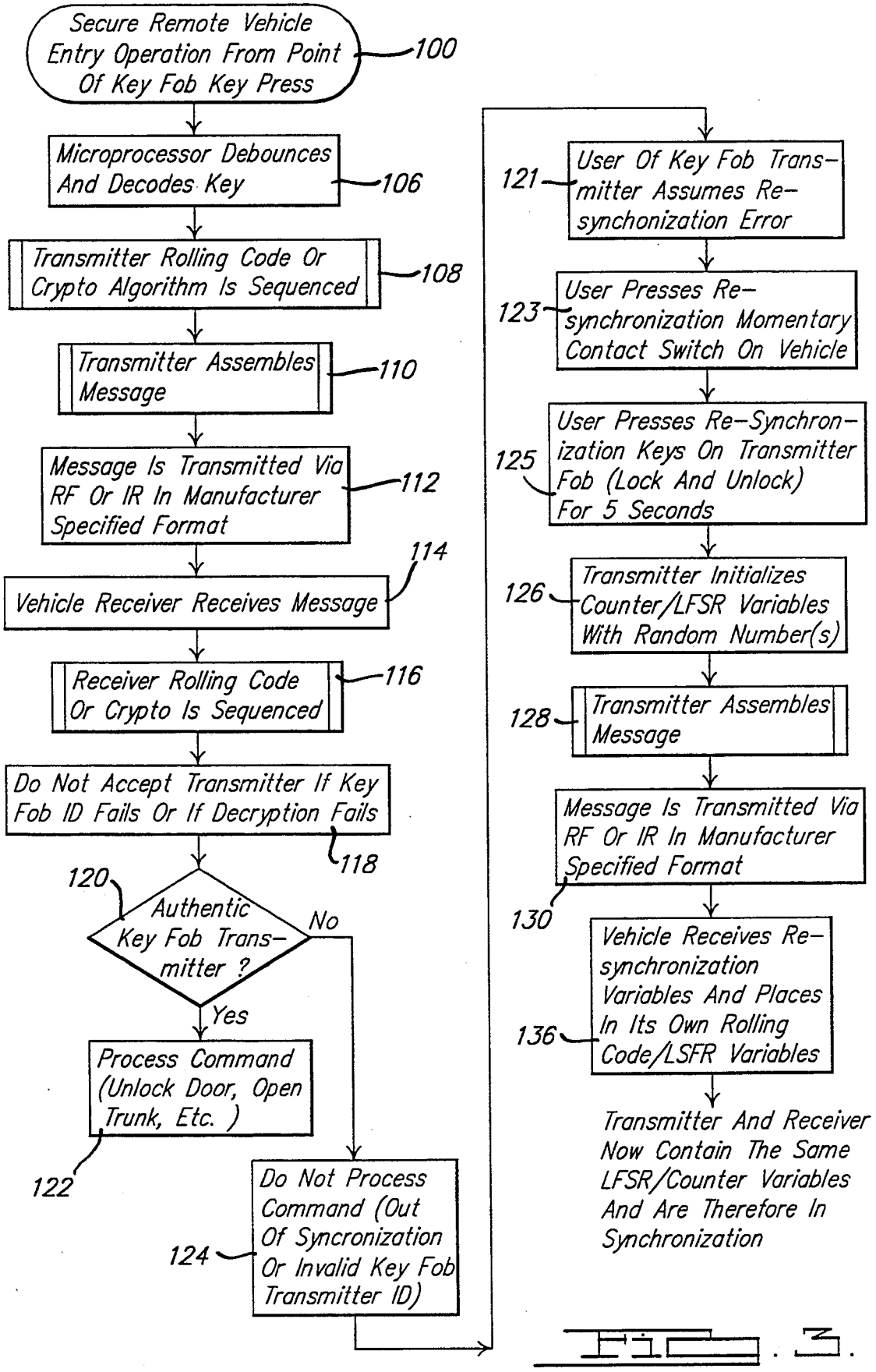

Referring to FIG. 3, the synchronizing method is illustrated, beginning at the point at which a key fob key is pressed (state 100). From this state control proceeds to step 106 where the user's keypad input is debounced and decoded by the transmitter microprocessor. Thereafter, the transmitter rolling code or cryptographic algorithm is sequenced, as indicated at step 108. Additional details regarding the sequencing operations are set forth in connection with FIGS. 4 and 5.

Once the rolling code has been sequenced, the transmitter assembles a message at step 110 and this message is broadcast at step 112 via RF or IR transmission to the receiver located in the vehicle. The vehicle receiver then receives the transmitted message at step 114 whereupon the receiver performs its rolling code or cryptographic algorithm sequencing at step 116. At this point, the authentication codes generated at steps 108 and 116, respectively are compared at step 118. If the authentication codes match and i f the transmitted command properly decodes, then the transmitter is deemed to be authentic at step 120 and the process command is performed at step 122.

In the alternative, if the authentication codes do not match, or if the transmitted command is not meaningfully decoded, then step 120 will cause the process to branch to step 124 at which the sequence is deemed to be out of synchronization or alternatively an invalid key fob transmitter may be assumed. In other words, at step 124 either the wrong transmitter was used (in which case the command will never be successful) or the right transmitter was used but it is out of sequence with the receiver (in which case resynchronization will be required).

The command having failed at step 124, the user thus determines at step 121 that the failure is due to a resynchronization error. In response, (step 123) the user presses a resynchronization button such as a momentary contact switch on the vehicle. In addition, (step 125) the user presses the resynchronization key on the transmitter fob. While a separate button may be provided, the presently preferred embodiment interprets the simultaneous pressing of both lock and unlock buttons for 5 seconds to constitute a request for resynchronization. At step 126 the transmitter initializes its counter and loads its LFSR variables with random numbers. The transmitter then assembles a message at step 128 and this message is transmitted via RF or IR transmission at step 130 to the receiver. Upon completion of step 130, in step 136, the receiver acquires the resynchronization variables sent from the transmitter and places them in its own rolling code LFSR variable registers, whereupon the transmitter and receiver will now both contain the same LFSR and counter variables and are therefore in synchronization.

Further Implementation Details

Figure 4:
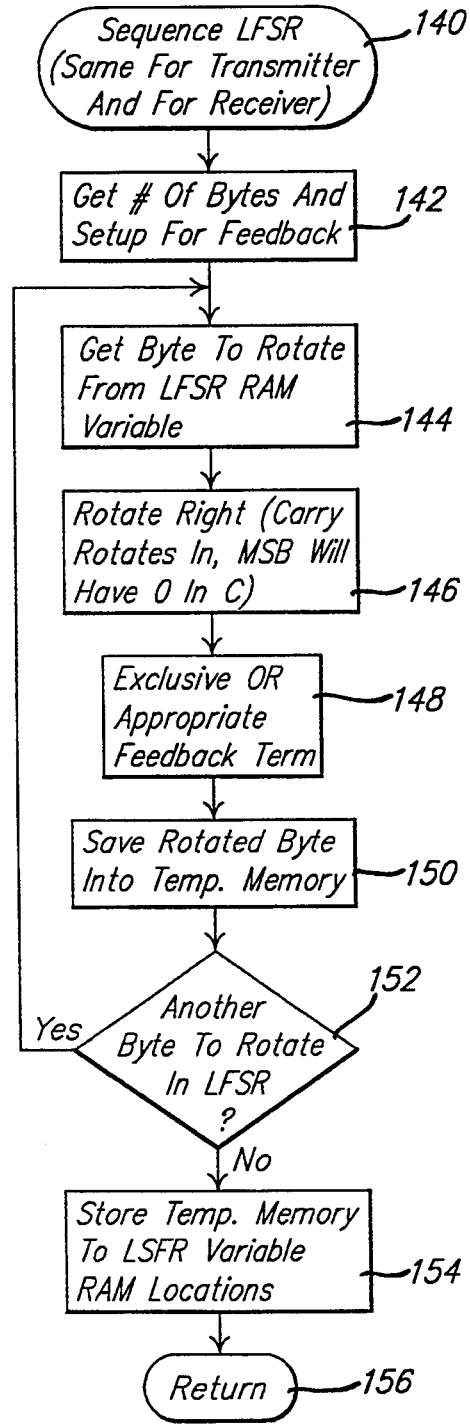
Figure 5:
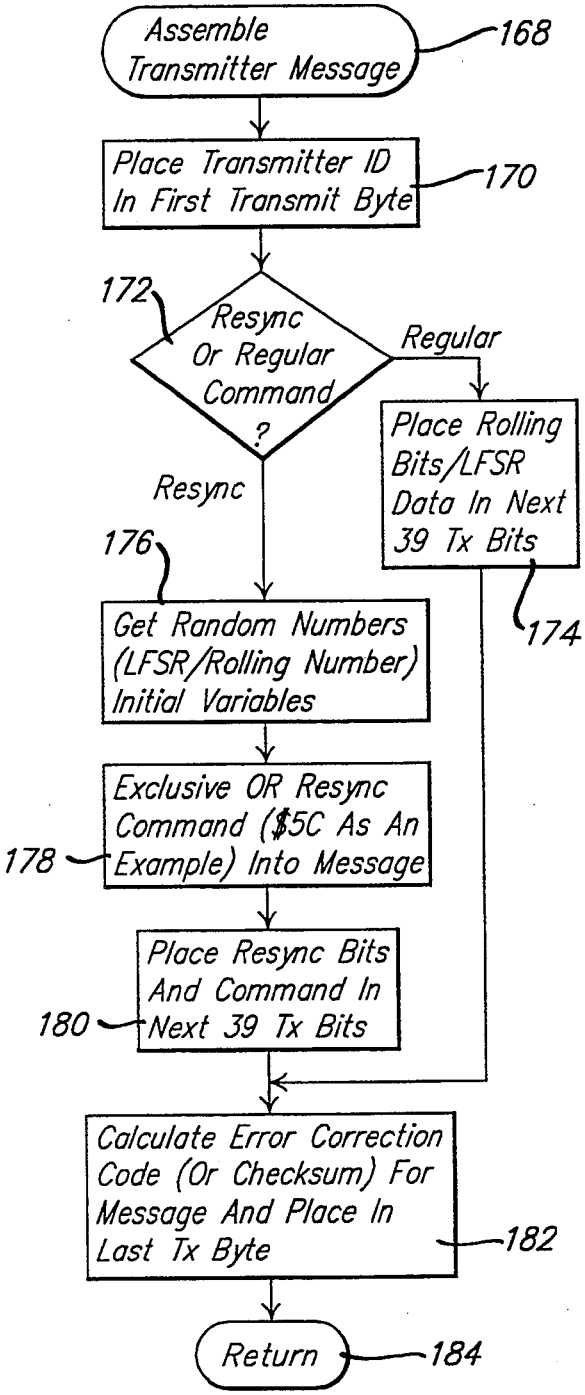

The LFSR sequence utilized by both transmitter and receiver is illustrated in FIG. 4. Beginning at step 140, the sequence proceeds to step 142 where the number of bytes in the sequence is supplied and a software loop is initiated to effect the LFSR rotation. As previously explained, one or more exclusive OR operations may be interposed between selected bits of a given byte or word. (In FIG. 1 a single exclusive OR operation was positioned between bit 1 and bit 0). In step 142 the selected position of one or more exclusive OR operations is set up, so that the appropriate exclusive OR operations will occur as the cycle proceeds. If desired, the selected configuration of exclusive OR operations can be supplied as a digital word or "mask" to be applied as a setup parameter. Alternatively the mask can be permanently or semi-permanently manufactured into the system or programmed into the system by the manufacturer or dealer.

Next, at step 144, a byte is fetched into the LFSR RAM variable so that the LFSR sequence can be performed upon it. This is illustrated at steps 146, 148 and 150. In step 146 a rotate-right operation is performed on the LFSR variable, with the most significant bit (MSB) having a forced zero in its carry register. The exclusive OR operations are performed at step 148, with the resultant being supplied as feedback terms in accordance with the setup mask established at step 142. Then, in step 150, the rotated byte resulting from steps 146 and 148 is stored into a temporary memory location. Next, at step 152, if there are additional bytes queued up for rotation, the sequence returns to step 144 where the next byte is fetched and the process is repeated.

Once all of the bytes have been rotated according to steps 144–150, the temporary memory (stored as step 150) is written to the LFSR variable in RAM and control returns (step 156) to the calling program.

Figure 5:
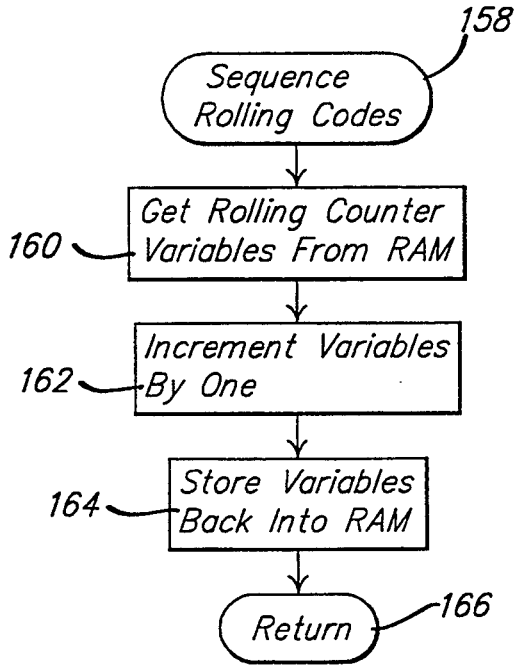

FIG. 5 depicts, beginning at step 158, the manner of sequencing rolling codes. As depicted at step 160, the rolling counter variable is retrieved from RAM, this variable is then incremented by one (step 162) and stored back in RAM (step 164). Control then returns to the calling program (step 166).

The presently preferred embodiment assembles transmitter messages as illustrated in FIG. 6. Beginning at step 168, the transmitter message is assembled by first placing the transmitter ID in the first transmission byte (step 170). Next, a decision is made (step 172) as to whether the message is a resychronization message or a regular command. Regular commands are assembled (step 174) by placing the rolling bits and LFSR data in the next 39 bits to be transmitted. If the command is a resynchronization command, the message is assembled by first generating or fetching random numbers (step 176) which serve as LFSR/rolling number initial variables. Next, at step 178, the exclusive OR resync command is inserted into the message. Thereafter (step 180) the resynchronization bits are placed in the message along with the desired command into the next 39 transmission bits.

Once the message has been assembled (either regular or resynchronization) an error correction code or checksum is calculated for that message and it is also placed in the message at the last transmission byte location. In this way, the message to be sent from transmitter to receiver is assembled. The receiver is thus able to decode the message by following the reverse procedure. After the message is assembled the routine returns (step 184) to its calling program.

While a rolling code authentication using linear feedback shift register technology has been illustrated, the method of synchronizing transmitter and receiver is not limited to LFSR techniques.

While the invention has been described in its presently preferred embodiment, it will be understood that the invention is capable of modification without departing from the spirit of the invention as set forth in the appended claims.

What is claimed is:

1. A method of synchronizing transmitter and receiver in a keyless entry system of the type which uses encrypted access codes to prevent unauthorized access, comprising:

storing secret information data in the transmitter and storing the same secret information data in the receiver, said secret information including a resynchronization authorization code;

storing at least a first access code in said transmitter and at least a first access code in said receiver, the access codes serving to permit access if transmitter and receiver first access codes match and to prevent access if transmitter and receiver first access codes do not match;

initiating a resynchronization sequence and in response to initiating a resynchronization sequence, generating a first random number access code at said transmitter;

using said transmitter to transmit said resynchronization authorization code and said first random number access code to said receiver;

substituting said first random number access code for the first access code in said transmitter;

in said receiver comparing the transmitted resynchronization authorization code with the resynchronization authorization code stored in said receiver;

if the transmitted resynchronization authorization code and the resynchronization authorization code stored in said receiver match, substituting said first random number access code for the first access code in said receiver;

whereby the first access codes of transmitter and receiver are reset to match one another, thereby synchronizing transmitter and receiver.

2. The method of claim 1 wherein said secret information data includes a seed value and said step of generating first random number uses said seed value in the random number generation.

3. The method of claim 1 wherein said secret information is stored in said transmitter and in said receiver in nonvolatile memory.

4. The method of claim 1 wherein said secret information is permanently stored in said transmitter and in said receiver.

5. The method of claim 1 wherein said secret information is stored in said transmitter and in said receiver by programming electrically alterable memory disposed in said transmitter and in said receiver.

6. The method of claim 5 wherein said programming step is performed writing data to said memory using voltages unavailable on the transmitter and receiver.

7. The method of claim 1 further comprising, storing a plurality of access codes in said receiver, the plurality including said first access code;

copying the first access code of the receiver to a different one of said plurality of access codes and replacing the first access code of the receiver with a new access code supplied at least in part by said transmitter each time access is permitted;

said transmitter and receiver first access codes serving to permit access if transmitter and receiver first access codes match and provided the first access code of the receiver is not a duplicated of any of the other access codes of said plurality of access codes.

* * * * *